US009389581B2

(12) United States Patent
Kitajima et al.

(10) Patent No.: US 9,389,581 B2
(45) Date of Patent: Jul. 12, 2016

(54) TONER FOR DEVELOPING ELECTROSTATIC IMAGE, DEVELOPER FOR ELECTROSTATIC IMAGE, TONER CARTRIDGE, PROCESS CARTRIDGE, AND IMAGE FORMING APPARATUS

(75) Inventors: Katsuyuki Kitajima, Kanagawa (JP); Yutaka Saito, Kanagawa (JP); Michio Take, Kanagawa (JP); Yoshifumi Iida, Kanagawa (JP); Motoko Sakai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 130 days.

(21) Appl. No.: 13/112,699

(22) Filed: May 20, 2011

(65) Prior Publication Data

US 2012/0156601 A1 Jun. 21, 2012

(30) Foreign Application Priority Data

Dec. 15, 2010 (JP) ..... 2010-279757

(51) Int. Cl.

| | |
|---|---|
| ***G03G 9/093*** | (2006.01) |
| ***G03G 21/18*** | (2006.01) |
| ***G03G 9/08*** | (2006.01) |
| ***G03G 9/087*** | (2006.01) |
| ***G03G 9/09*** | (2006.01) |

(Continued)

(52) U.S. Cl.

CPC ..... *G03G 21/18* (2013.01); *G03G 9/0819* (2013.01); *G03G 9/08711* (2013.01); *G03G 9/08795* (2013.01); *G03G 9/08797* (2013.01); *G03G 9/09* (2013.01); *G03G 9/09716* (2013.01); *G03G 9/09725* (2013.01); *G03G 15/0189* (2013.01); *G03G 15/0855* (2013.01); *G03G 15/0865* (2013.01)

(58) Field of Classification Search

CPC G03G 9/09725; G03G 9/0819; G03G 9/0821
USPC ..... 430/108.2
See application file for complete search history.

(56) References Cited

U.S. PATENT DOCUMENTS 5,422,218 A * 6/1995 Tong ..... 430/108.3
5,837,414 A 11/1998 Kitani et al.

(Continued)

FOREIGN PATENT DOCUMENTS

JP A-6-266152 9/1994
JP A-9-319134 12/1997

(Continued)

OTHER PUBLICATIONS

Derwent-abstract.Title: Electrostatic charge image developing toner uses external additive having two different inorganic microparticle of different average particle diameter (2006-612805).*

(Continued)

*Primary Examiner* — Stewart Fraser
*Assistant Examiner* — Olatunji Godo
(74) *Attorney, Agent, or Firm* — Oliff PLC

(57) ABSTRACT

A toner for developing an electrostatic image, including: toner particles containing at least a binder resin, a release agent, and a colorant; and an external additive having a volume average particle diameter (d) of from 70 nm to 400 nm, a ratio (d/σ) of the volume average particle diameter (d) to a standard deviation (σ) of a volumetric basis particle diameter of from 2.0 to 12, and an average circularity of from 0.5 to 0.9.

20 Claims, 3 Drawing Sheets

(51) Int. Cl.

| | |
|---|---|
| ***G03G 9/097*** | (2006.01) |
| ***G03G 15/01*** | (2006.01) |
| ***G03G 15/08*** | (2006.01) |

(56) References Cited

U.S. PATENT DOCUMENTS

| | | | | |
|---|---|---|---|---|
| 6,077,635 | A | 6/2000 | Okado et al. | |
| 6,137,977 | A | 10/2000 | Okado et al. | |
| 6,403,271 | B1 | 6/2002 | Suzuki et al. | |
| 7,163,773 | B2 | 1/2007 | Sugiura et al. | |
| 7,169,526 | B2 | 1/2007 | Ishikawa et al. | |
| 7,344,816 | B2 | 3/2008 | Matsumura et al. | |
| 7,611,815 | B2 | 11/2009 | Sugiura et al. | |
| 2002/0048473 | A1 | 4/2002 | Yamada et al. | |
| 2002/0061457 | A1 | 5/2002 | Okuno et al. | |
| 2002/0115008 | A1* | 8/2002 | Suzuki et al. | 430/108.7 |
| 2003/0134217 | A1 | 7/2003 | Combes et al. | |
| 2003/0148203 | A1* | 8/2003 | Suzuki et al. | 430/110.3 |
| 2003/0219667 | A1 | 11/2003 | Matsumoto et al. | |
| 2004/0067189 | A1 | 4/2004 | Sugiura et al. | |
| 2004/0197693 | A1* | 10/2004 | Ninomiya et al. | 430/108.7 |
| 2005/0164109 | A1* | 7/2005 | Iizuka et al. | 430/108.1 |
| 2006/0045571 | A1 | 3/2006 | Matsuura et al. | |
| 2006/0251979 | A1* | 11/2006 | Watanabe et al. | 430/108.6 |
| 2007/0009823 | A1 | 1/2007 | Skorokhod et al. | |
| 2007/0042285 | A1 | 2/2007 | Kitani et al. | |
| 2007/0099105 | A1 | 5/2007 | Itoh | |
| 2007/0218387 | A1* | 9/2007 | Ishii et al. | 430/108.7 |
| 2007/0274737 | A1 | 11/2007 | Serizawa et al. | |
| 2008/0014527 | A1* | 1/2008 | Kotsugai et al. | 430/125.3 |
| 2008/0086951 | A1 | 4/2008 | Wakamiya et al. | |
| 2008/0096116 | A1 | 4/2008 | Utsumi et al. | |
| 2008/0268362 | A1 | 10/2008 | Kudo | |
| 2008/0286668 | A1 | 11/2008 | Ishigami et al. | |
| 2009/0042121 | A1 | 2/2009 | Toizumi et al. | |
| 2009/0123857 | A1 | 5/2009 | Shu et al. | |
| 2009/0196658 | A1 | 8/2009 | Sugiura | |
| 2010/0203443 | A1 | 8/2010 | Okita et al. | |
| 2010/0233607 | A1 | 9/2010 | Asano et al. | |
| 2010/0248110 | A1 | 9/2010 | Taguchi et al. | |
| 2011/0097659 | A1 | 4/2011 | Sugiura et al. | |
| 2011/0287355 | A1 | 11/2011 | Udo | |
| 2011/0318581 | A1 | 12/2011 | Zenitani et al. | |
| 2012/0156601 | A1 | 6/2012 | Kitajima et al. | |
| 2012/0231381 | A1 | 9/2012 | Kitajima et al. | |
| 2012/0237864 | A1 | 9/2012 | Saito et al. | |
| 2013/0071781 | A1 | 3/2013 | Saito et al. | |
| 2013/0108949 | A1 | 5/2013 | Kitajima et al. | |

FOREIGN PATENT DOCUMENTS

| | | | |
|---|---|---|---|
| JP | H11-073005 | | 3/1999 |
| JP | A-11-174731 | | 7/1999 |
| JP | A-2001-066820 | | 3/2001 |
| JP | A-2002-108001 | | 4/2002 |
| JP | A-2004-102236 | | 4/2004 |
| JP | 2004-212789 | | 7/2004 |
| JP | A-2004-295110 | | 10/2004 |
| JP | A-2005-266557 | | 9/2005 |
| JP | A-2006-251220 | | 9/2006 |
| JP | A-2007-121882 | | 5/2007 |
| JP | A-2007-199579 | | 8/2007 |
| JP | A-2008-129125 | | 6/2008 |
| JP | A-2008-169102 | | 7/2008 |
| JP | A-2009-78935 | | 4/2009 |
| JP | A-2009-137791 | | 6/2009 |
| JP | 2009-149493 | A | 7/2009 |
| JP | A-2009-156978 | | 7/2009 |
| JP | 2010-224502 | | 10/2010 |
| JP | A-2010-243664 | | 10/2010 |
| JP | A-2011-59261 | | 3/2011 |
| WO | WO 2006/070871 | * | 7/2006 |

OTHER PUBLICATIONS

U.S. Appl. No. 13/351,783, filed Jan. 17, 2012 in the name of Yutaka Saito et al.
U.S. Appl. No. 13/432,918, filed Mar. 28, 2012 in the name of Katsuyuki Kitajima et al.
Nov. 29, 2012 Office Action issued in Australian Patent Application No. 2012202495.
Mar. 14, 2013 Office Action issued in Australian Patent Application No. 2012202495.
Apr. 24, 2013 Office Action issued in U.S. Appl. No. 13/432,918.
Nov. 27, 2012 Office Action issued in Australian Patent Application No. 2012202495.
Feb. 1, 2013 Office Action issued in U.S. Appl. No. 13/351,783.
U.S. Appl. No. 13/214,710, filed Aug. 22, 2011 in the name of Yutaka Saito et al.
U.S. Appl. No. 13/214,793, filed Aug. 22, 2011 in the name of Katsuyuki Kitajima et al.
Apr. 11, 2013 Office Action issued in U.S. Appl. No. 13/214,793.
Jul. 29, 2013 Office Action issued in U.S. Appl. No. 13/214,710.
Aug. 7, 2013 Office Action issued in U.S. Appl. No. 13/214,793.
Aug. 14, 2013 Office Action issued in U.S. Appl. No. 13/432,918.
May 31, 2013 Office Action issued in U.S. Appl. No. 13/351,783.
Office Action in U.S. Appl. No. 13/351,782 mailed Sep. 20, 2013.
Apr. 30, 2014 Office Action issued in U.S. Appl. No. 13/214,710.
Feb. 13, 2014 Office Action issued in U.S. Appl. No. 13/351,783.
Jan. 9, 2014 Office Action issued in U.S. Appl. No. 13/214,710.
Nov. 11, 2014 Office Action issued in Japanese Patent Application No. 2011-055609 with English translation.
Mar. 12, 2015 Office Action issued in Korean Application No. 10-2011-0105100.
Sep. 22, 2014 Office Action issued in Korean Patent Application No. 10-2011-0105103 w/translation.
Sep. 1, 2014 Notification issued in Japanese Patent Application No. 2011-055609 (including English Translation).
Sep. 22, 2014 Office Action issued in Korean Application No. 10-2011-0105100 (including English Translation).
Nov. 14, 2014 Office Action issued in U.S. Appl. No. 13/214,710.
Apr. 28, 2014 Submission of Information cited in Japanese Application No. 2010-279757 (with English Translation).
Jul. 15, 2014 Office Action issued in Japanese Application No. 2010-279757 (with English Translation).
Aug. 4, 2014 Office Action issued in U.S. Appl. No. 13/214,710.

* cited by examiner

TONER FOR DEVELOPING ELECTROSTATIC IMAGE, DEVELOPER FOR ELECTROSTATIC IMAGE, TONER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2010-279757 filed Dec. 15, 2010.

BACKGROUND

1. Technical Field

The present invention relates to a toner for developing an electrostatic image, a developer for an electrostatic image, a toner cartridge, a process cartridge, and an image forming apparatus.

2. Related Art

A toner for developing an electrostatic image usually contains external additives.

SUMMARY

According to an aspect of the present invention, there is provided a toner for developing an electrostatic image, comprising:

toner particles containing at least a binder resin, a release agent, and a colorant; and an external additive having a volume average particle diameter (d) of from 70 nm to 400 mu, a ratio (d/σ) of the volume average particle diameter (d) to a standard deviation (σ) of a volumetric basis particle diameter of from 2.0 to 12, and an average circularity of from 0.5 to 0.9.

BRIEF DESCRIPTION OF THE DRAWINGS

Exemplary embodiments of the present invention will be described in detail based on the following figures, wherein.

DETAILED DESCRIPTION

Figure 1:
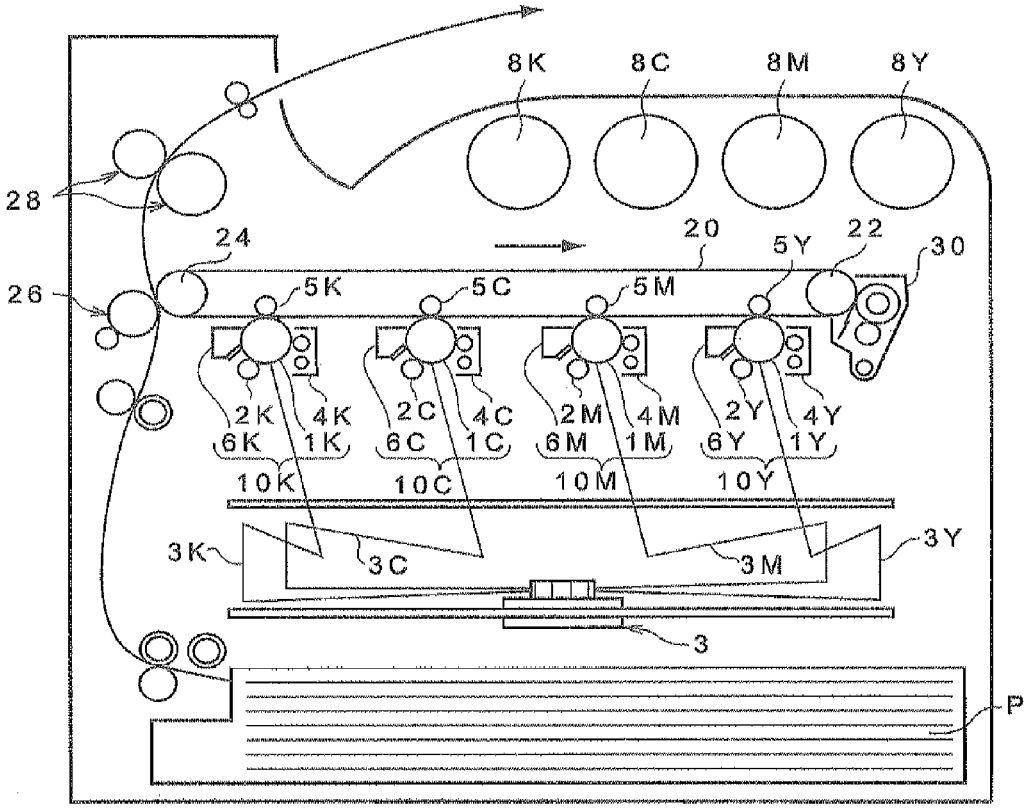
FIG. 1 is a schematic constitutional drawing that shows an example of the image forming apparatus of the present exemplary embodiment.

Hereinafter, the exemplary embodiments of a toner for developing an electrostatic image, an electrostatic image developer, a toner cartridge, a process cartridge, and an image forming device of the present invention will be described in detail below.

<Toner for Developing Electrostatic Image>

The toner for developing an electrostatic image according to the present exemplary embodiment (hereinafter referred simply as "toner") contains toner particles and an external additive. The external additive has a volume average particle diameter (d) of from 70 nm to 400 nm, a ratio of the volume average particle diameter (d) to a standard deviation (σ) of a volumetric basis particle diameter (d/σ) of from 2.0 to 12, and an average circularity of from 0.5 to 0.9.

In recent years, the particle diameter of a toner has tended to become smaller in order to obtain excellent transferred image quality. As the particle diameter of a toner is reduced, it is required to increase the impact force on the toner in a development apparatus during stirring for the purpose of acquiring the appropriate charge, and thus, the external additive is more likely to be buried in the toner particles. The surface of such toner particles has an increased non-electrostatic adhesion force with respect to a member such as a photoreceptor. Thus, a toner with a smaller particle diameter is likely to reduce the transfer ability due to burial of the external additive, resulting in lower toner density.

Therefore, it has been proposed to use a spherical external additive with a large diameter of 70 nm or more for toner particles with a small particle diameter. This allows for prevention of the external additive from burying in the toner particles to suppress the lower toner density.

However, an external additive with a large particle diameter is likely to roll on the surfaces of toner particles without being anchored to the toner particles, and thus to locally reside in concave portions and the like on the surfaces of the toner particles. Thus, a benefit of use of the external additive is likely to be reduced with time, which results in an increased non-electrostatic adhesion force with respect to a member such as a photoreceptor and a reduced transfer ability, leading to a lower toner density. Further, an external additive with a large particle diameter is likely to be detached from toner particles, and then the detached additive can transfer to the carrier to reduce the charging ability of the carrier, resulting in a reduced granularity of the formed image. Also, long-term storage tends to cause the external additive to be buried, whereby image quality defects such as, for example, white streaks and white/colored spots are generated.

Therefore, for the toner of the present exemplary embodiment, a larger external additive with a volume average particle diameter of from 70 nm to 400 nm is used; a ratio of the volume average particle diameter (d) to a standard deviation (σ) of a volumetric basis particle diameter (d/σ) is adjusted to a value in the range of from 2.0 to 12 to narrow the particle size distribution; and the average circularity is adjusted to a value in the range of from 0.5 to 0.9.

Because the external additive according to the present exemplary embodiment has a low average circularity (i.e., high shape irregularity), the contact points with respect to the surfaces of toner particles increase, and the external additive is prevented from rolling on the surfaces of the toner particles, resulting in suppression of the localization of the external additive. As a result, variation in image density is reduced even after long-term use. Further, because the contact points between the external additive and toner particles increase and the impact force on the toner in a development apparatus during stirring is dispersed, the external additive is less likely to be buried in the toner particles.

Because the external additive as described above has a narrow particle size distribution (a ratio of the volume average particle diameter (d) to the standard deviation (σ) of the volumetric basis particle diameter (d/σ)) of from 2.0 to 12.0, variation in shape irregularity of the external additive is suppressed. This allows for reduction of the content of a spherical external additive, which is likely to roll on toner particles, resulting in suppression of localization of the external additive overall on the surfaces of the toner particles.

As described above, the toner of the present exemplary embodiment allows for reduction of variation in image density due to long-term use, even under harsh conditions in which toner particles are subject to an impact force, such as conditions in which a low-density image is formed in an environment with high humidity and high temperature. Further, the toner prevents the external additive from rolling into concave parts and allows the external additive to reside at convex parts, resulting in prevention of exposure of the toner and excellent storage stability.

Now, each component of the toner according to the present exemplary embodiment will be described.

(External Additive)

First, the external additive will be described.

As described above, an external additive having a volume average particle diameter (d) of from 70 nm to 400 nm, a ratio of the volume average particle diameter (d) to the standard deviation (σ) of the volumetric basis particle diameter (d/σ) of from 2.0 to 12, and an average circularity of from 0.5 to 0.9 is at least used.

--Volume Average Particle Diameter (d)--

The external additive has a volume average particle diameter (d) of from 70 nm to 400 nm, desirably from 140 nm to 300 nm, and more desirably from 210 nm to 300 nm. When the external additive has a volume average particle diameter (d) of 70 nm or more, the toner particles are prevented from adhering together, resulting in suppression of reduced granularity. When the external additive has a volume average particle diameter (d) of 400 nm or less, the external additive is prevented from being detached from toner particles, and thus contamination within an image forming device after storage is prevented, resulting in suppression of image degradation.

In order to determine the volume average particle diameter of the external additive, the surfaces of the toner particles for the 100 external additives (particles) are observed. The images of the toner surface to be observed are analyzed using image processing and analysis software WINROOF available from Mitani Corp.

--Particle Size Distribution--

The external additive has a ratio (d/σ) of the volume average particle diameter (d) to the standard deviation (σ) of the volumetric basis particle diameter of from 2.0 to 12, and more desirably from 3.0 to 12.

When d/σ is 2 or more, the local presence of the external additive on the surfaces of the toner particles is effectively suppressed as a whole; variation in image density in long-term use is reduced; and the long-term storage stability is excellent. In consideration of production of the external additive, d/σ is 12 or less.

The standard deviation (σ) of the volumetric basis particle diameter of an external additive is determined by analysis of the image which is obtained when the volume average particle diameter is determined.

--Average Circularity--

The external additive has an average circularity of from 0.5 to 0.9, and more desirably from 0.65 to 0.80.

The external additives with an average circularity within the above range have the lower circularity than commonly-used external additives. Such irregularly shaped additives are prevented from rolling on the surface of toner particles and allow for reduction of variation in image density in long-term use. Further, the external additives are prevented from rolling into concave parts of toner particles and allowed to reside in convex parts, resulting in prevention of exposure of the toner and excellent storage stability.

The average circularity of the external additive of the present invention is not less than 0.5 from the viewpoint of manufacturing, and not more than 0.9 from the viewpoint of prevention from rolling on the surface of toner particles and reduction of variation in image density even in long-term use.

In order to determine the average circularity, the images of the 100 external additives (particles) are analyzed. The circularity of each of the external additive particles photographed is calculated by the following equation, and the resultant values are averaged in the manner similar to that for the volume average particle diameter.

$$\text{Circularity}=\text{Perimeter of Equivalent Circle Diameter}/\text{Perimeter}=[2\times(A\pi)^{1/2}]/PM$$

In the above equation, A represents the project area of the external additive, and PM represents the perimeter of the external additive. When the average circularity is 1.0, the external additive is a perfect sphere. The lower the value is, the more concavities and convexities the perimeter has and the higher shape irregularity is.

--Materials--

The effects from the toner according to the present exemplary embodiment are mechanically achieved through the volume average particle diameter, the particle size distribution, and the average circularity. Thus, the materials of the external additive are not limited, as long as the external additive has a volume average particle diameter, a particle size distribution, and an average circularity within the ranges described above, and any materials known in the art may be used. Hereinafter, the materials that may be used for the external additive will be described.

The external additive includes those well-known in the art, including inorganic and organic particles. In particular, the inorganic particles include any particles which are generally used for an external additive on the surface of a toner, including, for example, silica (such as, for example, fumed silica and sol-gel silica), alumina, titania, zinc oxide, tin oxide, iron oxide, calcium carbonate, magnesium carbonate, tricalcium phosphate, and cerium oxide. The organic particles include any particles which are generally used for an external additive on the surface of a toner, including, for example, vinyl resins, polyester resins, silicone resin, and fluorine resins.

--Production Method--

As described above, any materials may be used for the external additive, as long as the average circularity and the others are within the ranges described above. A method for producing sol-gel silica which has the average circularity and the others within the ranges described above is shown below as an example of the external additive.

The method for producing the sol-gel silica includes a process of preparing an alkali catalyst solution which contains the alkali catalyst at a concentration of from 0.6 mol/L to 0.85 mol/L (hereinafter sometimes referred to as a process of preparing an alkali catalyst solution) and a process of adding tetraalkoxysilane to the alkali catalyst solution and adding an alkali catalyst in an amount of from 0.1 mol to 0.4 mol per mole of the total tetraalkoxysilane added per minute (hereinafter sometimes referred to as a process of creating particles).

In essence, in the production method, tetraalkoxysilane as a feedstock is added to the solution containing an alkali catalyst at the concentration described above and an alcohol, and then an alkali catalyst as a catalyst is added in the above amount, allowing the tetraalkoxysilane to be reacted to create silane particles.

This method for producing silica particles provides silica particles which form less loose aggregates and have a low circularity. Although the precise reason is uncertain, the reason may be as follows:

First, when an alkali catalyst solution in which the alkali catalyst is contained in a solvent containing alcohol is prepared, and then tetraalkoxysilane and an alkali catalyst are separately added to the solution, the tetraalkoxysilane added to the alkali catalyst solution is reacted to create core particles. When the alkali catalyst solution contains the alkali catalyst at the concentration within the range described above, core particles with a low circularity are created, while restricting formation of loose aggregates such as secondary aggregates. In addition to catalysis, the alkali catalyst is provided on the surface of the core particles created, contributing to the shape and the dispersion stability of the core particles. Further, when the amount of the catalyst is within the range described above, the surface of the core particles is not uniformly coated with the catalyst (i.e., the catalyst is non-uniformly attached to the surface of the core particles). This may result in retention of the dispersion stability of the core particles, while in local differences in the surface tension and the chemical affinity of the core particles, with the result that core particles with a low circularity are formed.

when the tetraalkoxysilane and the alkali catalyst are each continued to be added, reaction of the tetraalkoxysilane causes the created core particles to grow to give silane particles. It is believed that if the tetraalkoxysilane and the alkali catalyst are added in the amounts which allow for preservation of the conditions described above, formation of loose aggregates such as secondary aggregates is suppressed, and the core particles with a low circularity grow while retaining shape irregularity, with the result that silica particles with a low circularity are formed. It is believed that addition of the tetraalkoxysilane and the alkali catalyst while preserving the conditions described above allows for retention of dispersiveness of the core particles and local differences in the tension and the chemical affinity on the surface of the core particles, resulting in particle growth of the core particles while retaining shape irregularity.

In view of the foregoing, this method for producing silica particles provides silica particles which form less loose aggregates and have a low circularity.

The amount of the tetraalkoxysilane may be connected to the particle size distribution and the circularity of the silica particles. If tetraalkoxysilane is added in an adding rate of from 0.002 mol/(mol·min) to 0.0075 mol/(mol·min), the probability of contact between the tetraalkoxysilane added dropwise and the core particles may decrease, with the result that the tetraalkoxysilane is uniformly provided to the core particles before the tetraalkoxysilane alone is reacted. Thus, this may allow for uniform reaction between the tetraalkoxysilane and the core particles. This may result in suppression of variation in the particle growth, allowing for production of silica particles with a narrow distribution.

Therefore, when tetraalkoxysilane is added in the amount within the range described above, it becomes easy to produce silica which has a ratio of the volume average particle diameter to the standard deviation of from 2.0 to 12.

As a note, the volume average particle diameter of the silica particles may depend on the total amount of tetraalkoxysilane added.

In this method for producing silica particles, because irregular-shaped core particles are created and the particles are grown while retaining the irregular shapes to produce silica particles, irregular-shaped silica particles which have high shape stability to mechanical load may be obtained.

In this method for producing silica particles, because the irregular-shaped core particles formed are grown while retaining the irregular shapes to form silica particles, the silica particles which are resistant to mechanical load and difficult to fracture may be obtained.

In this method for producing silica particles, because separate addition of tetraalkoxysilane and an alkali catalyst to an alkali catalyst solution causes the tetraalkoxysilane to be reacted to form particles, the total amount of the alkali catalyst used is reduced compared to the case in which irregularly-shaped silica particles are produced through the traditional sol-gel method, resulting in omission of a process of removing the alkali catalyst. This is beneficial especially when silica particles are used for a product which requires high purity.

Now, the process of preparing an alkali catalyst solution will be described.

In the process, a solvent which contains alcohol is prepared, and then an alkali catalyst is added to the solvent to prepare the alkali catalyst solution.

The solvent which contains alcohol may be a solvent which contains alcohol alone or, where necessary, a mixture with another solvent such as water, a ketone such as acetone, methyl ethyl ketone, and methyl isobutyl ketone; a cellosolve such as methyl cellosolve, ethyl cellosolve, butyl cellosolve, and cellosolve acetate; and an ether such as dioxane and tetrahydrofuran.

When the mixture is used, the alcohol is contained at a level of 80% by mass or more (desirably 90% by mass or more) with respect to an amount of the total solvent including the other solvent.

The alcohol includes, for example, a lower alcohol such as methanol and ethanol.

On the other hand, the alkali catalyst is a catalyst for promoting a reaction (hydrolysis and condensation) of the tetraalkoxysilane. The examples of the catalyst include, for example, a basic catalyst such as ammonia, urea, monoamine, and quaternary ammonium salt, and especially preferably ammonia.

The concentration (content) of the alkali catalyst is in the range of from 0.6 mol/L to 0.87 mol/L, desirably in the range of from 0.63 mol/L to 0.78 mol/L, and more desirably in the range of from 0.66 mol/L to 0.75 mol/L.

If the concentration of the alkali catalyst is less than 0.6 mol/L, the dispersibility of the core particles in the growth process becomes unstable, with the result that loose aggregates such as secondary aggregates are formed and that the particles gelate, which may lead to narrowing of the particle size distribution.

In contrast, if the concentration of the alkali catalyst is more than 0.87 mol/L, the stability of the formed core particles becomes excessive, with the result that core particles with a perfect sphere are formed, and it becomes difficult to obtain irregularly-shaped core particles with an average circularity of 0.90 or less.

As a note, the concentration of the alkali catalyst is based on the alcohol solvent solution (the solvent containing the alkali catalyst and alcohol).

Now, the process of forming particles will be described.

The process is one of forming silica particles by separately adding tetraalkoxysilane and an alkali catalyst to the alkali catalyst solution and causing a reaction (hydrolysis and condensation) of the tetraalkoxysilane.

In The process, the reaction of the tetraalkoxysilane causes formation of core particles in the early stage of addition of tetraalkoxysilane (the stage of forming core particles), and then the core particles is grown (the stage of growing core particles) to form silica particles.

The tetraalkoxysilane added to the alkali catalyst solution includes, for example, tetramethoxysilane, tetraethoxysilane, tetrapropoxysilane, and tetrabutoxysilane. In terms of the control of the reaction rate and the shape, the particle diameter, the particle size distribution, and the like of the silica particles to be obtained, tetramethoxysilane and tetraethoxysilane are preferable.

The tetraalkoxysilane is added in an amount of from 0.002 mol/(mol·min) to 0.0075 mol/(mol·min) with respect to the alcohol in the alkali solvent solution.

This means that the tetraalkoxysilane is added in an amount of from 0.002 mol to 0.0075 ml per minute with respect to 1 mol of the alcohol used in preparing the alkali solvent solution.

Although it depends on the type of tetraalkoxysilane and the reaction conditions, if the total amount of the tetraalkoxysilane used for the reaction for forming particles is, for example, 0.756 mol or more with respect to 1 L of a dispersion of the silica particles, the primary particles with a particle diameter of 70 nm or more are obtained. If the total amount is 4.4 mol or less with respect to 1 L of a dispersion of the silica particles, the primary particles with a particle diameter of 400 nm or less are obtained.

If tetraalkoxysilane is added in an amount of less than 0.002 mol/(mol·min), the probability of contact between the tetraalkoxysilane added dropwise and the core particles decreases, but it takes long time to finish adding the total amount of the tetraalkoxysilane, resulting in low production efficiency.

If tetraalkoxysilane is added in an amount of 0.0075 mol/(mol·min) or more, the tetraalkoxysilane alone may be reacted before reaction between the tetraalkoxysilane and the core particles. This enhances non-uniform provision of the tetraalkoxysilane to the core particles, causing variation in particle formation, and thus the distributions of the particle sizes and the shapes become wider, making it difficult to produce silica which has a ratio of the volume average particle diameter to the standard deviation of from 2.0 to 12.

Tetraalkoxysilane is desirably added in an amount of from 0.002 mol/(mol·min) to 0.006 mol/(mol·min), and more desirably from 0.002 mol/(mol·min) to 0.0045 mol/(mol·min).

On the other hand, the alkali catalyst which is added to the alkali catalyst solution includes the catalysts described above. Although the alkali catalyst added to the alkali catalyst solution may be the same as or different from the alkali catalyst already contained in the solution, the same catalyst is preferable.

The alkali catalyst is added in an amount of from 0.1 mol to 0.4 mol per mole of the total tetraalkoxysilane added per minute, desirably from 0.14 mol to 0.35 mol, and more desirably from 0.18 mol to 0.30 mol.

If the amount of the alkali catalyst is less than 0.1 mol, the dispersibility of the core particles in the growth process becomes unstable, with the result that loose aggregates such as secondary aggregates are formed and that the particles gelate, which may lead to narrowing of the particle size distribution.

In contrast, if the amount of the alkali catalyst is more than 0.4 mol, the stability of the formed core particles becomes excessive, and even if core particles with a low circularity are formed in the process of forming core particles, the core particles grow into spherical particles in the growth process, which may make it difficult to give silica particles with a low circularity.

In the process of forming particles, the tetraalkoxysilane and the alkali catalyst are separately added to the alkali catalyst solution. They may be added continuously or intermittingly.

In the process of forming particles, the temperature of the alkali catalyst solution when the tetraalkoxysilane and the alkali catalyst are added is, for example, in the range of from 5° C. to 50° C., and desirably in the range of from 15° C. from 40° C.

Silica particles are obtained through the processes described above. The silica particles are obtained in the form of a dispersion. The dispersion itself may be used, or the solvent may be removed from the dispersion to obtain the powders of the silica particles.

When the dispersion of silica particles is used, the concentration of the solid particles may be adjusted by diluting the dispersion with water or alcohol or condensing the dispersion, if necessary. Further, solvent in the dispersion of silica particles may be substituted to a water-soluble organic solvent such as another alcohol, an ester, a ketone or the like.

A method for removing the solvent in the dispersion of silica particles includes methods known in the art, including 1) a method in which the solvent is removed by filtration, centrifugation, distillation, or the like and the resultant is dried in a vacuum drier, a tray drier, or the like, and 2) a method in which the slurry is directly dried in a fluid bed drier, a spray drier, or the like. The drying temperature is, but not limited to, desirably 200° C. or lower. If the temperature is higher than 200° C., the primary particles are likely to become bonded to each other, or coarse particles are likely to occur due to condensation of silanol groups remaining on the surface of the silica particles.

Coarse particles and aggregates are preferably removed from the dried silica particles by milling and sieving, where necessary. The milling method includes, but not limited to, dry milling such as, for example, jet milling, vibrating milling, ball milling, pin milling, or the like. The sieving method includes methods known in the art such as, for example, vibrating sieving and wind sieving.

The surface of the silica particles obtained through this method for producing silica particles may be used after hydrophobic treatment with a hydrophobic treating agent.

The hydrophobic treating agent includes, for example, a known organosilicon compound which has an alkyl group (such as, for example, methyl, ethyl, propyl, or butyl group). The specific example includes, for example, a silazane compound (such as, for example, a silane compound including methyltrimethoxysilane, dimethyldimethoxysilane, trimethylchlorosilane, and trimethylmethoxysilane; hexamethyldisilazane; and tetramethylsilazane) and the like. The hydrophobic treating agent may be used either singly or in combination of two or more thereof.

Among these hydrophobic treating agents, preferred is an organosilicon compound which has a trimethyl group, such as trimethylmethoxysilane and hexamethyldisilazane.

In order to obtain the hydrophobic effect, the hydrophobic treating agent is used, for example, at a level of from 1% by mass to 100% by mass and desirably from 5% by mass to 80% by mass with respect to the silica particles, although not limited thereto.

A method for obtaining a dispersion of hydrophobic silica particles hydrophobic treated with a hydrophobic treating agent includes, for example, a method in which silica particles are hydrophobic treated by adding the needed amount of a hydrophobic treating agent to a dispersion of the silica particles and allowing the resultant to be reacted with stirring at a temperature of from 30° C. to 80° C. to obtain a dispersion of hydrophobic silica particles. If the temperature of this reaction is lower than 30° C., the hydrophobic reaction is difficult to progress, while if the temperature is higher than 80° C., self-condensation of the hydrophobic treating agent may easily cause gelation of the dispersion, mutual aggregation of the silica particles, and the like.

On the other hand, a method for obtaining hydrophobic silica particles in the form of powders includes a method in which a dispersion of hydrophobic silica particles is obtained by the method described above and then dried by the method described above to obtain the powders of hydrophobic silica particles; a method in which a dispersion of silica particles is dried to obtain the powders of hydrophilic silica particles and then the powders are hydrophobic treated by adding a hydrophobic treating agent to obtain the powders of hydrophobic silica particles; a method in which after a dispersion of hydrophilic silica particles is obtained and then dried to obtain the powders of the hydrophilic silica particles, the powders are hydrophobic treated by further adding a hydrophobic treating agent to obtain the powders of hydrophilic silica particles; and the like.

The method for hydrophobic-treating the powders of silica particles includes a method in which hydrophilic silica particles in the form of powders are stirred in a treatment bath such as a Henschel mixer and a fluid bed, and a hydrophobic treating agent is added to the bath, followed by gasification of the hydrophobic treating agent by heating the inside of the bath to allow it to be reacted with a silanol group on the surface of the silica particles in the form of powders. The treatment temperature is, but not limited to, for example, in the range of from 80° C. to 300° C., and desirably in the range of from 120° C. to 200° C.

The method for producing silica particles as described above provides silica which have a lower average circularity and a narrower particle size distribution (a smaller ratio of the volume average particle diameter (d) to the standard deviation (σ) of the volumetric basis particle diameter (d/σ)) than common silica.

The external additive is desirably added at a level of from 0.5 parts by mass to 5.0 parts by mass, more desirably from 0.7 parts by mass to 24.0 parts by mass, and still more desirably from 0.9 parts by mass to 3.5 parts by mass with respect to 100 parts by mass of the toner particles described below.

(Toner Particles)

Next, the toner particles will be described.

The toner particles contain at least a binder resin, a release agent, and a colorant, and where necessary, the toner particles may also contain other additives and the like.

--Binder Resin--

The binder resin will be described.

The binder resin includes a amorphous resin, and a amorphous resin and a crystalline resin may be used together.

The crystalline resin is preferably used at a level of from 5% by mass to 30% by mass with respect to the total amount of the toner particles. The amorphous resin is preferably used at a level of from 50% by mass to 90% by mass with respect to the total amount of the toner particles.

The term "crystalline resin" refers to a resin which does not exhibits a process change in the exotherm, but has a distinct endothermic peak in differential scanning calorimetry (DSC). In particular, the term refers to a resin which has a full width at half maximum of the endothermic peak of 6° C. or lower as measured at a temperature increase rate of 10° C./min.

On the other hand, the term "amorphous resin" refers to a resin which has a full width at half maximum of 6° C. or higher or which does not have a distinct endothermic peak. Preferably, in the present exemplary embodiment, a resin which does not have a distinct endothermic peak is used as the noncrystallin resin.

Any crystalline resin may be used with no particular suppression, as long as it is crystalline. The specific example includes a crystalline polyester resin and a crystalline vinyl resin. The crystalline polyester resin is preferable, and a crystalline aliphatic polyester resin is especially preferable.

The crystalline polyester resins and all other polyester resins are synthesized from, for example, a polycarboxylic acid component and a polyhydric alcohol component.

A commercially available polyester resin or a synthetic polyester resin may also be used.

The crystalline polyester resin is produced using the general polyester polymerization method in which an acid component and an alcohol component are reacted. For example, direct polycondensation, ester exchange, or the like is used, and which is used depends on the type of monomer.

The crystalline polyester may be produced at a polymerization temperature of from 180° C. to 230° C. When necessary, the pressure in the reaction system is reduced, and the reaction is effected while removing water and alcohol generated during condensation. If the monomer is insoluble or incompatible at the reaction temperature, a high boiling solvent may be added as a solubilizer to increase the solubility. The polycondensation reaction is effected while distilling off the solubilizer. If the monomer has a low compatibility in the copolymerization reaction, it is preferred to previously condense the monomer with a low compatibility with an acid or alcohol to be polycondensed with the monomer and then to copolymerize the resultant with the principal component.

The melting temperature of the crystalline resin is desirably in the range of from 50° C. to 100° C., and more desirably in the range of from 60° C. to 80° C.

The melting temperature of the crystalline resin refers to the peak temperature of the endothermal peak obtained by differential scanning calorimetry (DSC) as described above. Although a crystalline resin can exhibit plural melting peaks, the maximum peak is regarded as the melting temperature in the present exemplary embodiment.

The amorphous resin includes resin materials known in the art, and a amorphous polyester resin is especially desirable. The amorphous polyester resin includes primarily those obtained by polycondensation of a polycarboxylic acid and a polyhydric alcohol.

Preferably the polyester resin is produced by condensing the polyhydric alcohol with the polycarboxylic acid in accordance with routine procedures. For example, the polyhydric alcohol and the polycarboxylic acid, and a catalyst where necessary are placed in a reactor equipped with a thermometer, a stirrer, and a reflux condenser, and are heated in the presence of inert gas (such as nitrogen gas) at a temperature of from 150° C. to 250° C. Further, the by-product low molecule compound is continuously removed from the reaction system, and the reaction is stopped when the acid value reaches to a particular value. Then the resultant is cooled to obtain the reactant of interest.

Preferably the amorphous resin has desirably a weight average molecular weight (Mw) of from 5000 to 1000000, and more desirably from 7000 to 500000 as measured by gel permeation chromatography (GPC) using tetrahydrofuran (THF) as an eluent. Further, the amorphous resin has desirably a number average molecular weight (Mn) of from 2000 to 10000. The molecular weight distribution (Mw/Mn) is desirably in the range of from 1.5 to 100, and more desirably in the range of from 2 to 60.

In order to determine the above weight average molecular weight, GPC HLC-8120 from Tosoh Corp. equipped with TSKGEL SUPERHM-M columns (15 cm) from Tosoh Corp. are used with THF solvent. Further, the weight average molecular weight is determined with respect to a calibration curve created using monodisperse polystyrene standards.

The amorphous resin has desirably a glass transition temperature of from 35° C. to 100° C., and more desirably from 50° C. to 80° C.

The glass transition temperature of the amorphous resin is the peak temperature of the endothermal peak obtained by differential scanning calorimetry (DSC) as described above.

The amorphous resin has desirably a softening temperature of from 80° C. to 130° C., and more desirably from 90° C. to 120° C.

The softening temperature of the amorphous resin refers to a temperature intermediate to the temperature at which the inciting begins and the temperature at which the melting ends as measured with a flow tester (CFT-500C from Shimazu Corp.) in the conditions of a pre-heat rate of 80° C./300 sec, a plunger pressure of 0.980665 MPa, a die size of 1 mmϕ (1 mm, and a temperature increase rate of 3.0° C./min.

--Colorant--

The colorant will be described.

The colorant may constitute from 2% by mass to 15% by mass, and desirably from 3% by mass to 10% by mass with respect to the total amount of the toner particles.

The colorant includes organic or inorganic pigments and dyes known in the art and oil-soluble dyes.

For example, black pigments include carbon black, magnetic powders, and the like.

Yellow pigments include, for example, hansa yellow, hansa yellow 10G, benzidin yellow G, benzidin yellow GR, indanthrene yellow, quinoline yellow, permanent yellow NCG, and the like.

Red pigments include red oxide, watchung red, permanent red 4R, lithol red, brilliant carmine 3B, brilliant carmine 6B, Du Pont oil red, pyrazolone red, rhodamine B lake, lake red C, rose bengal, eosin red, alizarin lake, and the like.

Blue pigments include iron oxide, cobalt blue, alkali blue lake, victoria blue lake, fast sky blue, indathrene blue BC, aniline blue, ultramarine blue, chalco oil blue, methylene blue chloride, phthalocyanine blue, phthalocyanine green, malachite green oxalate, and the like.

These colorants may be combined and also used in the form of a solid solution.

--Release Agent--

Now, the release agent will be described.

The release agent constitutes from 1% by mass to 10% by mass, and desirably from 2% by mass to 8% by mass of the total amount of the toner particles.

Preferably the release agent has a main maximum peak of from 50° C. to 140° C., as measured in accordance with ASTMD3418-8.

The main maximum peak is measured with, for example, DSC-7 from PerkinElmer Inc. The instrument was calibrated with the melting temperature of indium and zinc for temperature and with the melting heat of indium for heat capacity. The sample is placed in an aluminum pan, and an empty pan is used as the reference. The measurement is made at a temperature increase rate of 10° C./min.

Preferably the release agent has a viscosity rel at 160° C. of from 20 cps to 600 cps.

The specific examples of the release agent include, for example, low molecular weight polyolefins such as polyethylene, polypropylene, and polybutene; silicones which can be softened by heating; fatty acid amides such as oleamide, erucamide, ricinoleamide, and stearamide; vegetable waxes such as carnauba wax, rice wax, candelilla wax, Japan wax, and jojoba oil; animal waxes such as bees wax; mineral and petroleum waxes such as montan wax, ozokerite, ceresine, paraffin wax, microcrystalline wax, and Fischer-Tropsch wax; and modified products thereof.

--Other Additives--

The other additives will be described.

The other additives include a variety of ingredients such as an internal additive, a charge control agent, inorganic powders (inorganic particles), and organic particles.

The internal additive includes, for example, metals such as ferrite, magnetite, reduced iron, cobalt, nickel, and manganese; the alloys thered and magnetic materials such as a compound containing the above metals.

The inorganic particles include those known in the art such as silica particles, titanium oxide particles, alumina particles, and cerium oxide particles, and those obtained by hydrophobic-treating the surface of the above particles. These inorganic particles may be surface treated by a variety of ways. Preferably the particles is surface treated with, for example, a silane coupling agent, a titanium coupling agent, silicone oil, or the like.

--Properties--

Now, the properties of the toner particles will be described.

The toner particles have desirably a volume average particle diameter D of from 3 μm to 9 μm, and more desirably from 3 μm to 6 μm.

The volume average particle diameter is measured using MULTISIZER II (from Beckman Coulter, Inc.) with an aperture diameter of 50 μm. Before the measurement, the toner is ultrasonically dispersed in an aqueous electrolyte solution (an aqueous isotone solution) for 30 seconds or more.

(Method for Producing Toner)

Now, a method for producing the toner according to the present exemplary embodiment will be described.

First, toner particles may be produced by either a dry production method (such as, for example, blending and milling processes) or a wet production method (such as, for example, aggregation and coalescence processes, suspension and polymerization processes, dissolution, suspension, and granulation processes, dissolution and suspension processes, and dissolution, emulsion, aggregation, and coalescence processes). The method is not particularly limited, and any method known in the art may be used.

The toner according to the present exemplary embodiment is produced by, for example, adding the external additive described above to the obtained toner particles and mixing them. Preferably the mixing process is carried out using, for example, a V-blender, a Henschel mixer, a Lodige mixer, or the like. Further, where necessary, coarse particles in the toner may be removed using a vibrating sieve, a wind sieve, or the like.

<Electrostatic Image Developer>

The electrostatic image developer according to the present exemplary embodiment contains at least the toner according the present exemplary embodiment.

The electrostatic image developer according to the present exemplary embodiment may be a mono-component developer which contains only the toner for developing an electrostatic image according to the present exemplary embodiment or a two-component developer in which the toner is mixed with a carrier.

The carrier includes, but not limited to, those known in the art. The carrier includes, for example, resin coated carriers, magnetic dispersed carriers, resin dispersed carriers, and the like.

In the two component developer, the mixing proportion (mass proportion) of the toner according to the present exemplary embodiment to the carrier as described above is desirably in the range of from 1:100 to 30:100, and more desirably in the range of from 3:100 to 20:100.

<Image Forming Device>

Now, the image forming device according to the present exemplary embodiment will be described.

The image forming device according to the present exemplary embodiment has a latent image holder; a charging device which charges a surface of the latent image holder; an electrostatic latent image-forming device which forms an electrostatic latent image on the surface of the charged latent image holder; a developing device which houses the electrostatic image developer, and develops the electrostatic latent image formed on the surface of a latent image holder into a toner image, using the electrostatic image developer; a transfer device which transfer the toner image onto a recording medium; and a fixing device which fixes the toner image on the recording medium. In the device, the electrostatic image developer according to the present exemplary embodiment as described above is used.

For example, the part containing the developing device in the image forming device according to the present exemplary embodiment may be a cartridge structure (process cartridge) removably attached to the image forming device. The preferred process cartridge includes one which has a developing device housing the electrostatic image developer according to the present exemplary embodiment. Further, for example, the portion housing an electrostatic image developer for replenishment in the image forming device may be a cartridge structure (toner cartridge) removably attached to the image forming device. The preferred toner cartridge includes one which houses the electrostatic image developer according to the present exemplary embodiment.

Now, the examples of the image forming device according to the present exemplary embodiment will be described, although the device is not limited thereto. The principal parts shown in the figures will be described, and the description of the other parts will be omitted.

FIG. 1 is a schematic structural drawing that shows a 4-drum tandem system color image forming apparatus that is the image forming apparatus of the exemplary embodiment. The image forming apparatus shown in FIG. 1 includes first to fourth electrophotographic image forming units 10Y, 10M, 10C and 10K (image forming means) that output images of respective colors of yellow (Y), magenta (M), cyan (C) and black (K) based on color-separated image data. These image forming units (hereinafter sometimes simply referred to as "units") 10Y, 10M, 10C and 10K are aligned in the horizontal direction at predetermined intervals. These units 10Y, 10M, 10C and 10K may be process cartridges that are attachable to and detachable from the main body of the image forming apparatus.

An intermediate transfer belt 20 as an intermediate transfer body runs through the respective units 10Y, 10M, 10C and 10K above the units in the drawing. The intermediate transfer belt 20 is wrapped around a driving roller 22 and a support roller 24 that is in contact with the inner surface of the intermediate transfer belt 20 which are disposed apart from each other in the direction from the left to the right of the drawing so that the belt runs in the direction from the first unit 10Y to the fourth unit 10K. The support roller 24 is biased toward the direction leaving from the driving roller 22 by a spring and the like that are not depicted, whereby a predetermined tension is applied to the intermediate transfer belt 20 that is wrapped around the rollers. An intermediate transfer body cleaning apparatus 30 is disposed on the side surface of the latent image holder of the intermediate transfer belt 20 so as to oppose to the driving roller 22.

Toners of 4 colors of yellow, magenta, cyan and black that are housed in toner cartridges 8Y, 8M, 8C and 8K are supplied to the respective developing apparatuses (developing device) 4Y, 4M, 4C and 4K of the respective units 10Y, 10M, 10C and 10K.

Since the above first to fourth units 10Y, 10M, 10C and 10K have similar structures, the first unit 10Y for forming a yellow image that is disposed on the upstream of the running direction of the intermediate transfer belt is explained as a representative. The explanations on the second to fourth units 10M, 10C and 10K are omitted by adding the reference symbols of magenta (M), cyan (C) and black (K) instead of yellow (Y) to the units that are similar to the first unit 10Y.

The first unit 10Y has a photoreceptor 1Y that acts as a latent image holder. A charging roller 2Y that charges the surface of the photoreceptor 1Y to a predetermined electrical potential, an exposing apparatus (unit configured to form an electrostatic latent image) 3 that exposes the charged surface to a laser beam 3Y based on color-separated image signal to form an electrostatic latent image, a developing apparatus (unit configured to develop) 4Y that supplies a charged toner to the electrostatic latent image to develop an electrostatic latent image, a primary transfer roller (unit configured to perform primary transfer) 5Y that transfers the developed toner image on the intermediate transfer belt 20, and a photoreceptor cleaning apparatus (unit configured to clean) 6Y that removes the toner remaining on the surface of the photoreceptor 1Y after the primary transfer are disposed in this order around the photoreceptor 1Y.

The primary transfer roller 5Y is disposed on the inside of the intermediate transfer belt 20, and is disposed on the position opposing to the photoreceptor 1Y. Furthermore, bias power sources (not depicted) that apply primary transfer bias are connected respectively to the respective primary transfer rollers 5Y, 5M, 5C and 5K. Each bias power source varies the transfer bias that is applied to each primary transfer roller by the control by a control section that is not depicted.

Hereinafter the operation for forming a yellow image at the first unit 10Y is explained. First, prior to the operation, the surface of the photoreceptor 1Y is charged to have an electrical potential of about from −600 V to −800 V by the charging roller 2Y.

The photoreceptor 1Y is formed by laminating a photosensitive layer on an electroconductive (volume resistance rate at 20° C.: $1\times10^{-6}$ Ωcm or less) substrate. The photosensitive layer has property that it has generally a high resistance (resistance similar to that of a general resin) but when the laser beam 3Y is irradiated, the specific resistance of the part to which the laser beam has been irradiated is changed. Therefore, the laser beam 3Y is output via an exposing apparatus 3 on the surface of the charged photoreceptor 1Y according to image data for yellow that is sent from a control section that is not depicted. The laser beam 3Y is irradiated on the photosensitive layer on the surface of the photoreceptor 1Y, whereby an electrostatic latent image having a yellow printing pattern is formed on the surface of the photoreceptor 1Y.

The electrostatic latent image is an image that is formed on the surface of the photoreceptor 1Y by charging, and is a so-called a negative latent image that is formed by that the specific resistance of the irradiated part of the photosensitive layer is decreased by the laser beam 3Y and the electron charge charged on the surface of the photoreceptor 1Y flows, whereas the electron charge on the part that has not been irradiated with the laser beam 3Y remains.

The electrostatic latent image formed on the photoreceptor 1Y as such is rotated to a predetermined developing position according to the running of the photoreceptor 1Y. Then, the electrostatic latent image on the photoreceptor 1Y is converted to a visible image (developed image) by the developing apparatus 4Y on this developing position.

The developing apparatus 4Y houses, for example, a developer for an electrostatic image including at least a yellow toner of the present exemplary embodiment. The yellow toner is friction-charged by being stirred in the developing apparatus 4Y, and retained on a developer roll (developer holder) with an electron charge having similar polarity (negative polarity) to that of the charge that is charged on the photoreceptor 1Y. Furthermore, as the surface of the photoreceptor 1Y passes through the developing apparatus 4Y, the yellow toner electrostatically adheres on the neutralized latent image section on the surface of the photoreceptor 1Y, whereby a latent image is developed by the yellow toner. The photoreceptor 1Y on which the yellow toner image has been formed runs continuously at a predetermined velocity, and the toner image developed on the photoreceptor 1Y is carried to a predetermined primary transfer position.

When the yellow toner image on the photoreceptor 1Y is carried to the primary transfer position, a primary transfer bias is applied to the primary transfer roller 5Y, an electrostatic force that goes from the photoreceptor 1Y to the primary transfer roller 5Y acts on the toner image, and the toner image on the photoreceptor 1Y is transferred on the intermediate transfer belt 20. The transfer bias applied at this time has a polarity that is opposite (+) to the polarity of the toner (−), and is controlled to be, for example, about +10 μA by the control section (not depicted) in the first unit 10Y.

On the other hand, the toner remaining on the photoreceptor 1Y is removed by the cleaning apparatus 6Y and collected.

The primary transfer biases that are applied to the primary transfer rollers 5M, 5C and 5K in the second unit 10M and the following units are controlled in accordance with the first unit.

Thus, the intermediate transfer belt 20 on which the yellow toner image has been transferred at the first unit 10Y is carried through the second to fourth units 10M, 10C and 10K in this order, whereby toner images of respective colors are superposed to effect multilayer transfer.

The intermediate transfer belt 20 on which the toner images of four colors have been superposed by multilayer transfer via the first to fourth units goes to the secondary transfer section that is constituted by the intermediate transfer belt 20, the support roller 24 that is in contact with the inner surface of the intermediate transfer belt 20, and a secondary transfer roller (secondary transfer device) 26 that is disposed on the side of the image retention surface of the intermediate transfer belt 20. On the other hand, recording paper (recording medium) P is fed via a feeding mechanism at a predetermined timing to a gap at which the secondary transfer roller 26 and the intermediate transfer belt 20 are brought into contact with pressure, and a secondary transfer bias is applied to the support roller 24. The transfer bias applied at this time has a polarity that is the same (−) as the polarity of the toner (−), and electrostatic force that goes from the intermediate transfer belt 20 toward the recording paper P acts on the toner image, whereby the toner image on the intermediate transfer belt 20 is transferred on the recording paper P. The secondary transfer bias at this time is determined according to the resistance that is detected by a means configured to detect resistance (not depicted) for detecting the resistance at the secondary transfer section, and is controlled by voltage.

The recording paper P is then fed to a fixing apparatus (fixing means) 28 and the toner image is heated, whereby the color-superposed toner image is melted and fixed on the recording paper P. The recording paper P on which fixing of a color image has been completed is carried toward an ejection section, whereby a series of operations for forming a color image is completed.

Although the image forming apparatus exemplified above has a structure in which the toner image is transferred on the recording paper P via the intermediate transfer belt 20, the structure is not limited to this, and a structure in which a toner image is directly transferred from a photoreceptor on recording paper may also be available.

<Process Cartridge and Toner Cartridge>

Figure 2:
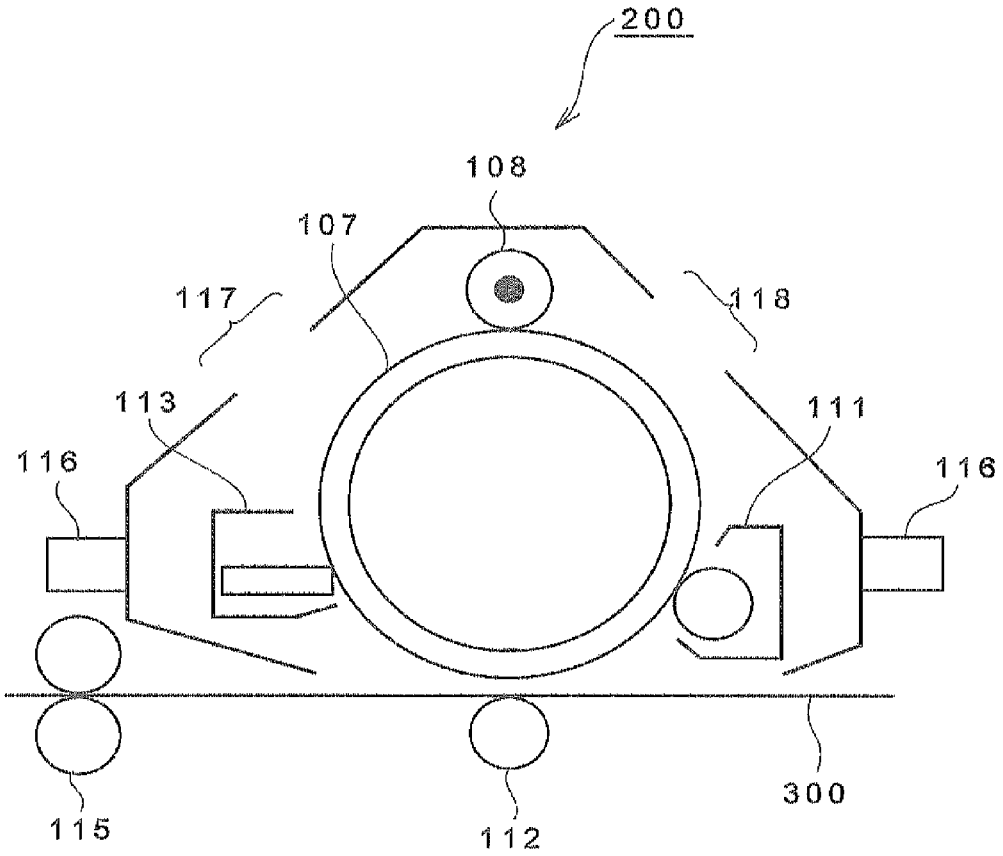
FIG. 2 is a schematic constitutional drawing that shows an example of the process cartridge of the present exemplary embodiment.

FIG. 2 is a schematic structural drawing that shows an example of a process cartridge that houses the developer for an electrostatic image of the present exemplary embodiment. Process cartridge 200 is obtained by combining and integrating a developing apparatus 111 together with a photoreceptor 107, a charging roller 108, a photoreceptor cleaning apparatus (unit configured to clean) 113, an opening for exposure 118 and an opening for exposure under neutralization 117 by using an attachment rail 116. Recording medium is represented by 300 in FIG. 2.

The process cartridge 200 is attachable to and detachable from the main body of the image forming apparatus that is constituted by the transfer apparatus 112, the fixing apparatus 115, and other structural parts that are not depicted, and constitutes the image forming apparatus together with the main body of the image forming apparatus.

Although the process cartridge 200 shown in FIG. 2 includes the photoreceptor 107, charging apparatus 108, developing apparatus 111, cleaning apparatus 113, opening for exposure 118, and opening for exposure under neutralization 117, these apparatuses may be selectively combined. The process cartridge of the present exemplary embodiment may include, besides the developing apparatus 111, at least one selected from the group consisting of the photoreceptor 107, charging apparatus 108, cleaning apparatus (means configured to clean) 113, opening for exposure 118 and opening for exposure under neutralization 117.

Next, the toner cartridge of the present exemplary embodiment is explained. The toner cartridge houses at least a toner to be supplied to the developing device that is disposed on the above image forming apparatus, which is mounted attachably and detachably on the image forming apparatus, and in which the toner is one of the present exemplary embodiment. The toner cartridge may house at least the toner, and for example, a developer may be housed depending on the mechanism of the image forming apparatus.

Accordingly, in the image forming apparatus on which the toner cartridge is mounted attachably and detachably, the toner cartridge housing the toner of the present exemplary embodiment easily supplies the toner of the present exemplary embodiment to the developing device.

The image forming apparatus shown in FIG. 2 is an image forming apparatus that has a structure that enables attaching and detaching of the toner cartridges 8Y, 8M, 8C and 8K, and the developing apparatuses 4Y, 4M, 4C and 4K are connected to toner cartridges that correspond to the respective developing apparatuses (colors) via toner supply tubes that are not depicted. Furthermore, when the toner housed in the toner cartridge is decreased, the toner cartridge is replaced.

EXAMPLES

Hereinafter the present invention is explained specifically with referring to Examples. However, the invention is not limited to only the Examples shown below. Unless otherwise mentioned, the "part" and "%" in the Examples mean "part by mass" and "% by mass", respectively.

Example 1

<Production of Toner 1>

(Preparation of Resin Particle Dispersion 1)

Styrene (from Wako Pure Chemical Industries, Ltd.): 320 parts n-butyl acrylate (from Wako Pure Chemical Industries, Ltd.): 80 parts β-carboxyethyl acrylate (from Rhodia Nicca, Ltd.): 9 parts 1,10-decanediol diacrylate (from Shin-Nakamura Chemical, Co. Ltd.): 1.5 parts Dodecanethiol (from Wako Pure Chemical Industries, Ltd.): 2.7 parts The above ingredients are mixed and dissolved. Then, a solution of 4 parts of anionic surfactant DOWFAX (from The Dow Chemical Co.) in 550 parts of ion exchanged water is added, and the resultant is dispersed and emulsified in a flask. Then a solution of 6 parts of ammonium persulfate in 50 parts of ion exchanged water is further added with slowly stirring and mixing for 10 minutes. After the flask is thoroughly flushed with nitrogen, the solution in the flask is heated to 70° C. in an oil bath with stirring, and the emulsion polymerization is continued for 5 hours to give Anionic Resin Particle Dispersion 1 having a solid content of 41%.

The resin particles in Anionic Resin Particle Dispersion 1 have a median particle diameter of 196 nm, a glass transition temperature of 51.5° C., and a weight average molecular weight Mw of 32400.

(Preparation of Resin Particle Dispersion 2)

Styrene (from Wako Pure Chemical Industries, Ltd.): 280 parts n-butyl acrylate (from Wako Pure Chemical Industries, Ltd.): 120 parts β-carboxyethyl acrylate (from Rhodia Nicca, Ltd.): 9 parts The above ingredients are mixed and dissolved. Then, a solution of 1.5 parts of anionic surfactant DOWFAX (from The Dow Chemical Co.) in 550 parts of ion exchanged water is added, and the resultant is dispersed and emulsified in a flask. Then a solution of 0.4 parts of ammonium persulfate in 50 parts of ion exchanged water is further added with slowly stirring and mixing for 10 minutes. After the flask is thoroughly flushed with nitrogen, the solution in the flask is heated to 70° C. in an oil bath with stirring, and the emulsion polymerization is continued for 5 hours to give Anionic Resin Particle Dispersion 2 having a solid content of 42%.

The resin particles in Anionic Resin Particle Dispersion 2 have a median particle diameter of 150 nm, a glass transition temperature of 53.2° C., a weight average molecular weight Mw of 41000, and a number average molecular weight Mn of 25000.

(Preparation of Colorant Particle Dispersion 1)

C.I. Pigment Yellow 74 Pigment 1: 30 parts

Anionic Surfactant (NEWREX R from NOF Corp.): 2 parts

Ion Exchanged Water: 220 parts

The above ingredients are mixed and pre-dispersed for 10 minutes using a homogenizer (IKA ULTRA TURRAX), followed by dispersion at a pressure of 245 Mpa for 15 minutes using an ultimizer (a counter collision wet pulverizer from Sugino Machine Ltd.) to give Colorant Particle Dispersion 1 having a median colorant particle diameter of 169 nm and a solid content of 22.0%.

(Preparation of Release agent Particle Dispersion 1)

Paraffin Wax HNP9 (melting temperature 75° C., from Nippon Seiro Co.): 45 parts

Cationic surfactant NEOGEN RK (from Dai-Ichi Kogyo Seiyaku Co.): 5 parts

Ion Exchanged Water: 200 parts

The above ingredients are mixed and heated to 100° C. After thorough dispersion using ULTRA TURRAX T50 from IKA, the resultant is dispersed using a pressure discharging Gorin homogenizer to give Release agent Particle Dispersion 1 having a median release agent particle diameter of 196 nm and a solid content of 22.0%.

(Production of Toner Particles)

Resin Particle Dispersion 1: 106 parts

Resin Particle Dispersion 2: 36 parts

Colorant Particle Dispersion 1: 30 parts

Release agent Particle Dispersion 1: 91 parts

The above ingredients are thoroughly mixed and dispersed in a stainless round flask using ULTRA TURRAX T50 to give a solution.

Then 0.4 parts of polyaluminum chloride is added to the solution to create aggregated particles, and the dispersion is continued using the ULTRA TURRAX. The solution in the flask is heated to 49° C. in an oil bath with stirring. After retaining the temperature for 60 minutes, 36 parts of Resin Particle Dispersion 1 is slowly added to create core/shell aggregated particles. Then 0.5 mol/L of aqueous sodium hydroxide is added, and the pH of the solution is adjusted to 5.6. Further, the stainless flask is sealed and heated to 96° C. with stirring, using magnetic seal. After retaining the temperature for 5 hours, the flask is cooled to give a yellow toner having a colorant concentration of 5%.

Next, a black toner dispersed in a solution is filtered and thoroughly washed with ion exchanged water, followed by filtration with suction through a nutsch filter to separate the solid and liquid. The resultant is re-dispersed in 3 L of ion exchanged water at 40° C. and stirred and washed at 300 rpm for 15 minutes. This operation is repeated another 5 times. When the filtrate has a pH of 7.01, a conductivity of 9.8 μs/cm, and a surface tension of 71.1 Nm, the filtrate is filtered with suction through a No. 5A nutsch filter to separate the soli and liquid. Then the resultant solid containing the yellow toner is dried in vacuum for 12 hours to give toner particles having an average particle diameter of 6.4 μm.

(Production of External Additive 1)

--Process for Preparing Alkali Catalyst Solution [Preparation of Alkali Catalyst Solution (1)]--

600 parts of methanol and 88 parts of 10% aqueous ammonia is placed into a 3 L glass reactor equipped with a metal stirrer, a dispense nozzle (microtube pump made of TEFLON (registered trademark)), and a thermometer, and mixed with stirring to give Alkali Catalyst Solution (1). Alkali Catalyst Solution (1) has a ratio of the volume of $NH_3$ to the volume of the alkali catalyst ($NH_3$ [mol]/(aqueous ammonia+methanol [L]) is 0.61 mol/L.

--Process for Forming Particles [Preparation of Silica Particle Suspension (1)]--

Next, the temperature of Alkali Catalyst Solution (1) is adjusted to 25° C., and Alkali Catalyst Solution (1) is flushed with nitrogen. Then 110 parts of tetramethoxysilane (TMOS) and 80 parts of aqueous ammonia which has a catalyst ($NH_3$) concentration of 4.4% is added dropwise in the following amount while stirring Alkali Catalyst Solution (1) to give a suspension of silica particles (Silica Particle Suspension (1)).

The amount of the tetramethoxysilane (TMOS) is 13 g/min with respect to the number of moles of methanol in Alkali Catalyst Solution (1), i.e., 0.046 mol/(mol·min).

The amount of the 4.4% aqueous ammonia is 4 g/min with respect to the total amount of the tetramethoxysilane added per minute (0.0855 mol/min)). It corresponds to 0.29 mol/min per mole of the total amount of the tetraalkoxysilane added per minute. The particles in the obtained Silica Particle Suspension (1) have a volume average particle diameter (D50v) of 75 nm and a (d/u) of 3.2.

--Hydrophobic Treatment of Silica Particles--

5.59 parts of trimethylsilane is added to 200 parts of Silica Particle Suspension (1) (solid content: 13.985%) for hydrophobic treatment. Then the resultant is heated at 65° C. and dried using a hot plate to form irregularly shaped Hydrophobic Silica Particles (1). The resultant Hydrophobic Silica Particles (1) are added to toner particles and SEM micrographs of the 100 primary particles of Hydrophobic Silica Particles (1) are made. Next, the image analysis of the micrographs shows that the primary particles of Hydrophobic Silica Particles (1) have an average circularity of 0.66.

Hydrophobic Silica Particles (1) are used as External Additive 1.

The volume average particle diameter (d) and the standard deviation (u) of the volumetric basis particle diameter of the obtained External Additive 1 are measured as described above. The results are shown in Table 2.

(Production of External Additives 2 to 7 and External Additives A1 to A5)

The alkali catalyst solutions are prepared in the same manner as that described above, except that methanol and 10% aqueous ammonia are used in the amount shown in Table 1. The amounts of $NH_3$ are shown in the column of "Amount of $NH_3$" of "10% Aqueous Ammonia" in Table 1.

Using the alkali catalyst solution described above, the silica particle suspensions are prepared as described above for External Additive 1 except that that tetramethoxysilane (TMOS) and the catalyst aqueous ammonia ($NH_3$) are added to the alkali catalyst solution at the levels shown in Table 1, and in the amounts and the relative amounts shown in Table 1.

Tetramethoxysilane (TMOS) is added to the alkali catalyst solution at the level shown in the column of "Parts by Mass" of "TMOS" of "Total Level" in Table 1 and in the amounts shown in the column of "TMOS" of "Amount per Minute (g/min)" in Table 1.

The catalyst aqueous ammonia ($NH_3$) is added to the alkali catalyst solution at the concentrations shown in the column of "Concentration of $NH_3$" of "Aqueous Ammonia" of "Total Level" in Table 1, at the levels shown in the column of "Parts by Mass" of "Aqueous Ammonia" of "Total Level" in Table 1, and in the amounts shown in the column of "Aqueous Ammonia" of "Amount Per Minute (g/min)" in Table 1.

In the column of "Amount of TMOS with respect to Methanol" of "Relative Amount" in Table 1, the amounts of TMOS are also shown as an amount with respect to the number of moles of methanol in the alkali catalyst solution. In the column of "Amount of $NH_3$ With respect to TMOS" of "Relative Amount" in Table 1, the amounts of the aqueous ammonia are also shown as an amount per mole of the total amount of tetramethoxysilane added per minute.

The particles are hydrophobic-treated and dried as described above for the production of External Additive 1 in Example 1.

(Production of Toner 1)

2.0 parts of External Additive 1 is added to 100 parts of Toner Particles 1 using a Henschel mixer to produce Toner 1.

Figure 3:
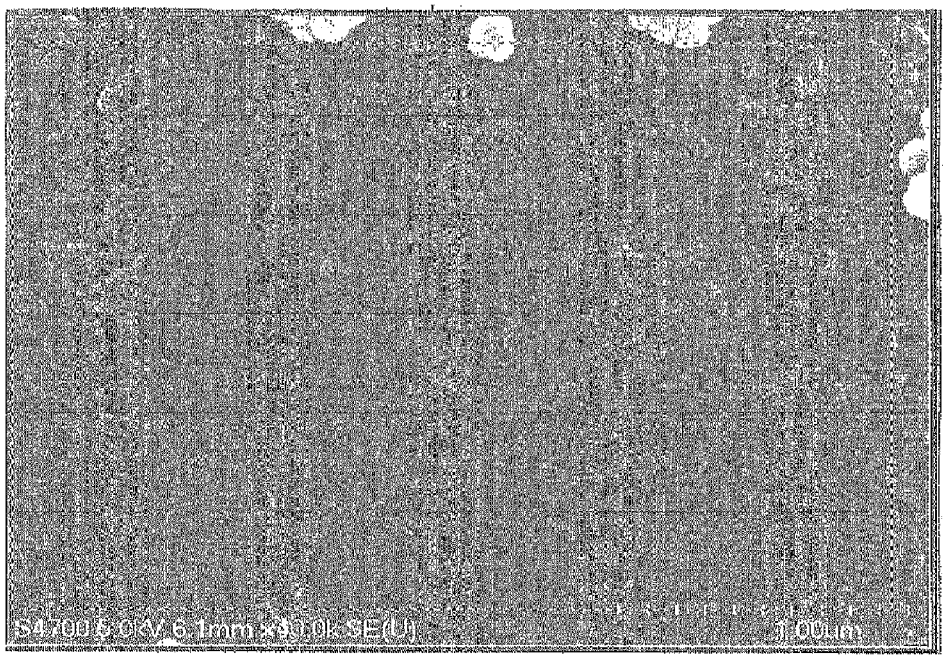
FIG. 3 is a photograph that shows the image analysis of Toner 1 in Example 1.

The image analysis of the resultant Toner 1 shows that the external additive (silica particles) has an average circularity of 0.65 as measured as described above. The photograph of the image analysis of Toner 1 is shown in FIG. 3.

<Production of Carrier>

--Production of Carrier 1--

Ferrite Particles (average particle size: 50 μm): 100 parts

Toluene: 14 parts

Copolymer of Styrene and Methacrylate (component ratio: 90/10): 2 parts

Carbon Black (R330 from Cabot Corp.): 0.2 parts

The above ingredients except for ferrite particles are stirred for 10 minutes with a stirrer to prepare a dispersed coating solution. Then the solution and ferrite particles are placed into a vacuum degassing kneader and stirred at 60° C. for 30 minutes. The resultant is degassed under reduced pressure with heating and then dried to give Carrier 1.

<Production of Developer>

4 parts of Toner 1 and 96 parts of Carrier 1 are stirred at 40 rpm for 20 minutes using a V-blender and sieved using a 250 μm sieve to give a developer.

<Evaluation>

The obtained developer is evaluated for the following properties. The results are shown in Table 2.

(Variation in Concentration When Forming Low Density Image)

The reduction in image density is evaluated as described below.

The obtained developer is placed into the development apparatus of image forming device DOCUCENTRE COLOR 400 (from Fuji Xerox Co.), and 10 thousand images with an image density of 1% are continuously printed at 35° C. and 80% RH. Further, image density of 5 points in the first and the 10 thousandth images is measured using an image densitometer (X-RITE 968 from X-Rite, Inc.) to determine the density difference.

--Evaluation Criteria--

G1: Density difference of less than 0.15

G2: From 0.15 to 0.2 (not including 0.2)

G3: From 0.2 to 0.25 (not including 0.25)

G4: 0.25 and greater

G1 and G2 are acceptable, while G3 and G4 are unacceptable.

(Granularity)

10 thousand halftone images (image density 10%) are printed, and the granularity of the images is evaluated in accordance with the following evaluation criteria.

-- Evaluation Criteria--

G1: No roughness observed and no problem in practical use at all

G2: Partial slight roughness observed, but no problem in practical use

G3: Slight roughness observed in wider area than G2, but no problem in practical use G4: Roughness observed and problematic in practical use G5: Significant roughness observed and problematic in practical use (Image Quality after Storage)

The produced toner is stored in an atmosphere at 50° C. for 96 hours. Then 3000 halftone images with an image density of 50% are printed using the toner. The first (initial) and the 3000th images are visually evaluated in accordance with the following evaluation criteria.

-Evaluation t Criteria--

G1: No problem

G2: Slight color streaks observed, but no problem in practical use

G3: Color streaks observed

Example 2

A developer is produced in the same manner as in Example 1 except that External Additive 2 as shown in Table 1 is used instead of External Additive 1 in Example 1. Further, the developer is evaluated for the same properties as Example 1. The results are shown in Table 2.

Example 3

A developer is produced in the same manner as in Example 1 except that External Additive 3 as shown in Table 1 is used instead of External Additive 1 in Example 1. Further, the developer is evaluated for the same properties as Example 1. The results are shown in Table 2.

Example 4

A developer is produced in the same manner as in Example 1 except that External Additive 4 as shown in Table 1 is used instead of External Additive 1 in Example 1. Further, the developer is evaluated for the same properties as Example 1. The results are shown in Table 2.

Example 5

A developer is produced in the same manner as in Example 1 except that External Additive 5 as shown in Table 1 is used instead of External Additive 1 in Example 1. Further, the developer is evaluated for the same properties as Example 1. The results are shown in Table 2.

Example 6

A developer is produced in the same manner as in Example 1 except that External Additive 6 as shown in Table 1 is used instead of External Additive 1 in Example 1. Further, the developer is evaluated for the same properties as Example 1. The results are shown in Table 2.

Example 7

A developer is produced in the same manner as in Example 1 except that External Additive 7 as shown in Table 1 is used instead of External Additive 1 in Example 1. Further, the developer is evaluated for the same properties as Example 1. The results are shown in Table 2.

Comparative Example 1

A developer is produced in the same manner as in Example 1 except that External Additive A1 as shown in Table 1 is used instead of External Additive 1 in Example 1. Further, the developer is evaluated for the same properties as Example 1. The results are shown in Table 2.

Comparative Example 2

A developer is produced in the same manner as in Example 1 except that External Additive A2 as shown in Table 1 is used instead of External Additive 1 in Example 1. Further, the developer is evaluated for the same properties as Example 1. The results are shown in Table 2.

Comparative Example 3

A developer is produced in the same manner as in Example 1 except that External Additive A3 as shown in Table 1 is used instead of External Additive 1 in Example 1. Further, the developer is evaluated for the same properties as Example 1. The results are shown in Table 2.

Comparative Example 4

A developer is produced in the same manner as in Example 1 except that External Additive A4 as shown in Table 1 is used instead of External Additive 1 in. Example 1. Further, the developer is evaluated for the same properties as Example 1. The results are shown in Table 2.

Comparative Example 5

A developer is produced in the same manner as in Example 1 except that External Additive A3 as shown in Table 1 is used instead of External Additive 1 in Example 1. Further, the developer is evaluated for the same properties as Example 1. The results are shown in Table 2.

TABLE 1

| | Process of Preparation Substrate | | | Process of Forming Particles | | | | | | |
|---|---|---|---|---|---|---|---|---|---|---|
| | | | | Total amount | | | | | | |
| | Methanol | 10% Aqueous Ammonia | | TMOS | Aqueous Ammonia | | Amount per Minute (g/min) | | Relative Amount | |
| | Parts by Mass | Parts by Mass | Amount of $NH_3$ (mol/L) | Parts by Mass | Parts by Mass | Concentration of $NH_3$ (%) | TMOS (g/min) | Aqueous Ammonia (g/min) | Amount of $NH_3$ (vs. TMOS) (mol/min) | Amount of TMOS (vs. Methanol) (mol/(mol * min)) |
| External Additive 1 | 600 | 88 | 0.61 | 110 | 80 | 4.4 | 13 | 4 | 0.29 | 0.0046 |
| External Additive 2 | 600 | 95 | 0.65 | 400 | 110 | 4.4 | 11 | 4 | 0.11 | 0.0039 |
| External Additive 3 | 600 | 100 | 0.68 | 600 | 160 | 4.4 | 7 | 5 | 0.11 | 0.0025 |
| External Additive 4 | 600 | 100 | 0.68 | 460 | 120 | 4.4 | 19 | 4 | 0.10 | 0.0067 |
| External Additive 5 | 600 | 90 | 0.62 | 400 | 160 | 4.4 | 10 | 3.9 | 0.16 | 0.0035 |
| External Additive 6 | 600 | 95 | 0.65 | 560 | 160 | 4.4 | 8 | 2 | 0.11 | 0.0028 |

TABLE 1-continued

| | Process of Preparation Substrate | | | Process of Forming Particles | | | | | | |
|---|---|---|---|---|---|---|---|---|---|---|
| | | | | Total amount | | | Amount per Minute (g/min) | | Relative Amount | |
| | Methanol | 10% Aqueous Ammonia | | TMOS | Aqueous Ammonia | | | | Amount of | Amount of |
| | Parts by Mass | Parts by Mass | Amount of $NH_3$ (mol/L) | Parts by Mass | Parts by Mass | Concentration of $NH_3$ (%) | TMOS (g/min) | Aqueous Ammonia (g/min) | $NH_3$ (vs. TMOS) (mol/min) | TMOS (vs. Methanol) (mol/(mol * min)) |
| External Additive 7 | 600 | 110 | 0.74 | 240 | 250 | 4.4 | 8 | 4 | 0.41 | 0.0028 |
| External Additive A1 | 600 | 95 | 0.65 | 120 | 100 | 4.4 | 6 | 3.5 | 0.33 | 0.0021 |
| External Additive A2 | 600 | 95 | 0.65 | 600 | 100 | 4.4 | 15 | 3 | 0.07 | 0.0053 |
| External Additive A3 | 600 | 110 | 0.74 | 500 | 210 | 4.4 | 21 | 7 | 0.17 | 0.0074 |
| External Additive A4 | 600 | 125 | 0.83 | 550 | 380 | 4.4 | 20 | 13 | 0.25 | 0.0070 |
| External Additive A5 | 600 | 120 | 0.80 | 450 | 350 | 4.4 | 15 | 12 | 0.31 | 0.0053 |

TABLE 2

| | External Additive | | | | Evaluation | | |
|---|---|---|---|---|---|---|---|
| | Type | Average Particle Diameter (d) (nm) | d/σ | Average Circularity | Concentration Variation (%) | Granularity | Image Quality After Storage |
| Example 1 | 1 | 75 | 3.2 | 0.65 | G1 | G3 | G1 |
| Example 2 | 2 | 200 | 9.6 | 0.72 | G1 | G2 | G1 |
| Example 3 | 3 | 395 | 8.0 | 0.80 | G1 | G3 | G2 |
| Example 4 | 4 | 212 | 2.5 | 0.71 | G1 | G1 | G1 |
| Example 5 | 5 | 220 | 11.3 | 0.75 | G1 | G1 | G1 |
| Example 6 | 6 | 289 | 7.4 | 0.64 | G2 | G1 | G1 |
| Example 7 | 7 | 150 | 9.0 | 0.80 | G1 | G2 | G1 |
| Comparative Example 1 | A1 | 61 | 5.2 | 0.84 | G2 | G5 | G1 |
| Comparative Example 2 | A2 | 452 | 7.4 | 0.75 | G2 | G1 | G3 |
| Comparative Example 3 | A3 | 208 | 1.5 | 0.73 | G4 | G1 | G1 |
| Comparative Example 4 | A4 | 256 | 5.5 | 0.93 | G4 | G1 | G1 |
| Comparative Example 5 | A5 | 147 | 11.0 | 0.95 | G4 | G2 | G1 |

As shown in the above table, it is found that when using External Additives 1 to 7 with a volume average particle diameter, a particle size distribution, and an average circularity within the specified range, and even when continuously printing 1 thousand images at a high temperature of 35° C., a high humidity of 80% RH, and a low image density of 1%, variation in image density is suppressed. Also, it is found that the granularity is excellent and the contamination level in the machine is low.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner for developing an electrostatic image, comprising:

toner particles containing at least a binder resin, a release agent, and a colorant; and an external additive comprising sol-gel silica particles, the sol-gel silica particles having:

an irregular shape, a volume average particle diameter (d) of from 70 nm to 400 nm, a ratio (d/σ) of the volume average particle diameter (d) to a standard deviation (σ) of a volumetric basis particle diameter of from 7.4 to 11.3, and an average circularity of from 0.5 to 0.9, wherein circularity is calculated by the following equation:

$$\text{Circularity}=\text{Perimeter of Equivalent Circle Diameter}/\text{Perimeter of Particle}=[2\times(A\pi)^{1/2}]/PM,$$

where:

A represents a projected area of the particle, and

PM represents the perimeter of the particle.

2. The toner for developing an electrostatic image according to claim 1, wherein a content of the external additive is in a range of from 0.5 parts by mass to 5.0 parts by mass with respect to 100 parts by mass of the toner particles.

3. The toner for developing an electrostatic image according to claim 1, wherein the external additive is treated with a hydrophobic treating agent.

4. The toner for developing an electrostatic image according to claim 3, wherein the hydrophobic treating agent is at least one of trimethylmethoxysilane or hexamethyldisilazane.

5. The toner for developing an electrostatic image according to claim 1, wherein the external additive is obtained by preparing an alkali catalyst solution which contains a first alkali catalyst and a solution including alcohol, and adding tetraalkoxysilane and a second alkali catalyst into the alkali catalyst solution.

6. The toner for developing an electrostatic image according to claim 5, wherein a concentration of the first alkali catalyst in the alkali catalyst solution is from 0.6 mol/L to 0.85 mol/L.

7. The toner for developing an electrostatic image according to claim 5, wherein an adding rate of the second alkali catalyst into the alkali catalyst solution is from 0.1 mol to 0.4 mol per mole of the total tetraalkoxysilane added per minute.

8. The toner for developing an electrostatic image according to claim 1, wherein the binder resin is a styrene-acryl resin.

9. The toner for developing an electrostatic image according to claim 1, wherein the binder resin has a weight average molecular weight (Mw) of from 5,000 to 1,000,000 as measured by gel permeation chromatography (GPC) using tetrahydrofuran (THF) as an eluent.

10. The toner for developing an electrostatic image according to claim 1, wherein the binder resin has a glass transition temperature of from 35° C. to 100° C.

11. The toner for developing an electrostatic image according to claim 1, wherein the binder resin has a softening temperature of from 80° C. to 130° C.

12. The toner for developing an electrostatic image according to claim 1, wherein a content of the colorant is from 2% by mass to 15% by mass with respect to a total amount of the toner particles.

13. The toner for developing an electrostatic image according to claim 1, wherein a content of the release agent is from 1% by mass to 10% by mass with respect to a total amount of the toner particles.

14. The toner for developing an electrostatic image according to claim 1, wherein the release agent has a viscosity $\eta 1$ at 160° C. of from 20 cps to 600 cps.

15. The toner for developing an electrostatic image according to claim 1, wherein the toner particles have a volume average particle diameter of from 3 μm to 9 μm.

16. A toner cartridge comprising the toner for developing an electrostatic image according to claim 1, wherein the toner cartridge is removably attached to an image forming device.

17. An electrostatic image developer comprising at least the toner for developing an electrostatic image according to claim 1.

18. A process cartridge comprising a developing device wherein the electrostatic image developer according to claim 17 is housed in the developing device, the developing device develops an electrostatic latent image formed on a surface of a latent image holder into a toner image using the electrostatic image developer, and the process cartridge is removably attached to an image forming device.

19. An image forming apparatus comprising:

a latent image holder;

a charging device which charges a surface of the latent image holder;

an electrostatic latent image-forming device which forms an electrostatic latent image on the surface of the charged latent image holder;

a developing device, wherein the electrostatic image developer according to claim 17 is housed in the developing device, and the developing device develops an electrostatic latent image formed on a surface of a latent image holder into a toner image using the electrostatic image developer;

a transfer device which transfers the toner image formed on the surface of the latent image holder onto a recording medium; and a fixing device which fixes the toner image on the recording medium.

20. A toner for developing an electrostatic image, comprising:

toner particles containing at least a binder resin, a release agent, and a colorant; and an external additive comprising particles having:

an irregular shape, a volume average particle diameter (d) of from 70 nm to 400 nm, a ratio (d/σ) of the volume average particle diameter (d) to a standard deviation (σ) of a volumetric basis particle diameter of from 7.4 to 12, and an average circularity of from 0.65 to 0.8, wherein circularity is calculated by the following equation:

$$\text{Circularity}=\text{Perimeter of Equivalent Circle Diameter}/\text{Perimeter of Particle}=[2\times(A\pi)^{1/2}]/PM,$$

where:

A represents a projected area of the particle, and

PM represents a perimeter of the particle.

* * * * *